United States Patent [19]

von Borcke et al.

[11] Patent Number: 4,995,201

[45] Date of Patent: Feb. 26, 1991

[54] DEVICE FOR THE SURFACE CLEANING OF A HOT DEFORMED PIPE END

[75] Inventors: Wulff-Eckard von Borcke, Haan; Wilfried Meyerling, Krefeld, both of Fed. Rep. of Germany

[73] Assignee: Mannesmann Aktiengesellschaft, Düsseldorf, Fed. Rep. of Germany

[21] Appl. No.: 485,303

[22] Filed: Feb. 27, 1990

[30] Foreign Application Priority Data

Mar. 1, 1989 [DE] Fed. Rep. of Germany ..... 3906937

[51] Int. Cl.[5] ..... B24C 3/16; B24C 3/32; B08B 3/00

[52] U.S. Cl. ..... 51/411; 51/439; 134/167 C; 134/100; 15/395

[58] Field of Search ..... 51/419, 420, 429, 439, 51/319, 410, 411, 321, 320, 290, 289; 15/395; 134/100, 167 C, 168 C, 169 C

[56] References Cited

U.S. PATENT DOCUMENTS 1,952,848 3/1934 Eckler ..... 51/439 X
3,109,262 11/1963 Weaver ..... 51/411
4,713,882 12/1987 Bianchi ..... 51/411 X
4,718,142 1/1988 Wahlers ..... 15/395

FOREIGN PATENT DOCUMENTS 2085772 5/1982 United Kingdom ..... 51/410

*Primary Examiner*—Frederick R. Schmidt
*Assistant Examiner*—Bruce P. Watson
*Attorney, Agent, or Firm*—Nils H. Ljungman & Associates

[57] ABSTRACT

A blasting device for cleaning the inner surface of a hot deformed pipe end has a blast lance of inner and outer coaxially aligned tubes which connect with a blast nozzle head having nozzles. Injectors on the inner tube direct carrier medium and abrasive in an annular chamber between the inner and the outer tubes, through the nozzles. An axial pipe coaxially disposed in the inner pipe carrier further carries medium through the blast nozzle head and a deflector attached to the blast nozzle has radially extending passageways that direct the same through the periphery of the blast nozzle head to provide a gas curtain to protect the undeformed pipe section from abrasive. A removeable heat resistant element is attached to the deflector to further protect the undeformed section of the pipe.

5 Claims, 3 Drawing Sheets

DEVICE FOR THE SURFACE CLEANING OF A HOT DEFORMED PIPE END

FIELD OF THE INVENTION

The present invention relates to a device for the surface cleaning of a hot deformed pipe.

BACKGROUND INFORMATION

During the production of pipes which are to be threaded together for the crude oil and natural gas industry, depending on the load and area of operation and the type of cut thread, the wall thickness of the end area is increased. Customarily, this is done in the fashion where a certain length of the pipe is hot deformed in a deforming press and the wall thickness is increased. The condition of the surface and the dimensional structural condition of the hot deformed pipe end permits a direct cutting of threads in only a few cases so that it is necessary to perform cleaning and the dimensional processing steps. For this purpose, the pipes with the deformed pipe ends are removed from the production line and are put on a cleaning stand. There, a semi-automatic grinding machine removes the rough surface scale. Afterwards the critical areas are improved and the deforming seams are ground off manually with a hand grinding machine. The deforming seams come about during the deforming process, where for instance, two deforming half molds, which work together are used and part of the material flows into the separation seam between the two deforming half molds. In another embodiment, four deforming half molds are employed where two of them work together as a pair. Also known is the use of an undivided housing in combination with a deforming half mold. In the latter case, the circular bead develops during the deforming process in the area of the transition point between the housing and the deforming half mold.

These beads are a problem on a turning machine for the cutting process which occurs later, because the undisturbed flow of shavings at this point is being obstructed. The unbalanced load leads to an increased wear and tear of the cutting tools with the mounting part of the tool holders affected adversely. Even if one were to make allowances for the stresses on the tool machinery, these beads are still a problem because they lead to a radial movement of the pipe to be worked on within the chucked jaws of the turning machine.

The manual cleaning and finishing of a heat deformed pipe is very expensive based on the use of personnel. Also, the surface quality achieved depends on the subjective evaluation of the operating personnel. Furthermore, depending on the outside surface of the deformation at the transition point in the deformed pipe ends can only be partially accommodated during the cleaning. Also, the grinding provides a danger for the highly stressed pipe connection. Depending on the quality of the manual grinding, dangerous grooves can be formed which reduce the endurance strength.

The removal of the scale can be made through the use of a jet stream, as an alternative to grinding. For the cleaning of the inner surfaces of pipes, it is known from (Bleche, Rohre, Profile 32 (1985) 6, Page 303) to utilize a rotatable nozzle head which is connected to a lance and is filled with a gas type carrier medium, customarily air under pressure, and an abrasive, and where at least one inclined blasting nozzle is located in a longitudinal plane in relation to the inner surface of the pipe. In the area of the nozzle head, the air pressure and the abrasive are mixed and are aimed towards the inner surface of the pipe. This device is of little use for the cleaning of the inner surface of the deformed ends because the rotating nozzle heads are large in size and are not usable for smaller inner pipe end diameters. From the viewpoint of weight, it is wasteful because the nozzle heads have to be supported with a device attached to a lance.

A further disadvantage is the fact that the device for the support of the nozzle head cannot be adjusted to the various inner diameters of a hot deformed pipe end. It is furthermore of a disadvantage, be it with the known jet stream applications, or be it in the type of free-pressure jet stream only from one or the other end, or be it in the type of a combination of pressure and vacuum blast, where a vacuum is developed at the end located across, that the abrasive will be distributed all over the entire pipe and subsequently an expensive cleaning procedure is thus required in order to clean the pipe.

OBJECT OF THE INVENTION

It is the object of the present invention to provide a device for the cleaning of the surface of a hot deformed pipe end with abrasive blasts, which device is suitable for the removal of scale on the inside surface on the hot deformed pipe end with an inner diameter of 160 mm, without an expensive support arrangement. The device is adjustable to different inner diameters and a subsequent cleaning of the upset pipe is not required.

SUMMARY OF THE INVENTION

The manual or semi-automatic grinding, which is performed after the last forging, is replaced with a procedure according to the present invention by an inner and outer blasting after each deforming step. The last mentioned point is of considerable importance because it has been discovered, that especially after deformation which occurred in several steps with several heat ranges, the danger exists that the scale particles stick, and can be forced into the material at the next deforming step. This deteriorates the starting area surface for the following mechanical operation, in such a way that the wall thickness additionally has to be increased to make sure that after the turning there are no more resulting defects.

It is important in the present process, that the entire deformed pipe end area, including the transition area, is covered. The blast systems known up to this time, be it the type with the free pressure blast, only from one or both ends, or be it the type of a combination pressure and vacuum blast, whereby the vacuum is being developed at the opposite end, they all have a disadvantage that the abrasive is distributed throughout the complete pipe and that subsequently an expensive cleaning process is thus required to clean the pipe. This is prevented in the present process. The carrier medium, with injector type abrasive in the form of an admixed stream is adjusted under a prearranged angle in the direction of the inlet end of the pipe to be blasted on the inner surface, so that the largest part of the blast material which rebounds from the inner surface is thrown in the direction of the input end. Now and then, material falls into the direction of the other pipe end. So that the abrasive cannot enter the inner area of the pipe, a certain amount of carrier medium, for instance, compressed air is separately added without a mixture of the abrasive, behind the blast point likewise aimed at the inner surface, so that a shielding air curtain is formed.

To assure that the total surface is being blasted completely, the pipe moves relative to the blast along its circumference and along its longitude direction during the blasting operation. This movement can be realized in that the pipe moves itself in the circumference and the longitude direction while the blasting device remains stationary, or vice-versa. In order to adjust the effect of the blast and the effect of the hurling action of the abrasive, which is bounced from the inner surface, the exit angle can be adjusted according to the contour of the inner surface to be blasted. This angle is chosen in such a manner that the angle is always an obtuse angle, always larger than 90°, between the axis of the impacting blast stream and the generatrix of the inner surface in the direction of the input end. This is especially important when the transition area from the deformed area to the undeformed pipe section is marked by a cone-shaped enlargement in the direction of the undeformed pipe section. In such a case, the angle inclination of the transition area would constitute the size for the choice of the blast angle. The conditions for an obtuse angle to have the effect of the hurling of the abrasive material in the cylindrical deformed area will be retained in any case.

The inner and outer blasting can occur simultaneously or separately and can be integrated into an operational step in the production line of the heated deforming process. With a corresponding adjustment of the timing, the flow of material can be improved and accelerated.

The removal of the deforming beads can be done by either grinding or blasting. So that the tools may be positioned in an optimal direction, it is suggested to measure the outer contour of the deformed pipe end without touching it. Because the area of the deforming seam changes within a certain band width of the changing contour, this information can be transformed into a control signal, in order to achieve the optimal working position of the tool. This is especially important in the case of the blasting, because the abrasive is focused toward the deforming bead so that the accumulated amount of material located on the deforming bead can be removed within a given time, or, respectively, that the deforming bead can be reduced to an acceptable measure.

The apparatus for the inside blasting of a pipe according to the present invention consists of a blast head which is attached to a lance, the head having at least one blast nozzle, which is located on the perimeter, and which nozzle axis is tilted in the direction towards the inlet end of the pipe to be blasted. It is also possible to arrange several nozzles with different adjusted exit angles, or groups of nozzles can be arranged on the blast head. Where groups of nozzles are used, the exit angles within each group are equal, but are different from group to group. One group, for example, can consist of two nozzles which are staggered at 180°, so that the nozzle head has to be turned 180° in order to cover the peripheral area of the entire inner surface of the pipe being cleaned. Where a nozzle group consists of four blast nozzles, only a swivel movement of 90° would be required. This swivel movement of the blast head has an advantage over the single 360° movement, in that sealing problems in the feeder lines are easily solved. For a separate feeding of carrier medium, a pipe is attached to an inner tube of the blast head, which inner tube is connected in the area of the front end of the blast head and communicates with radial ducts which extend to the outside.

A deflector, or disk-like element, is attached to the face side of the blast head and has a plurality of radial extending passageways. These passageways communicate with a central boring located in the middle into which the pipe, extending through the nozzle head, also discharges. For an effective screening, it is advantageous to divert the carrier medium somewhat in the direction of the inlet end of the pipe to be blasted so that the emerging curtain of carrier medium can counteract the blasting material which is falling backwards. This type of screening can be reinforced by providing on the blast head a removeable, flexible, heat resistant element. The outer diameter of the removeable, flexible, heat resistant element is at least equal to or somewhat larger than the largest inner diameter of the pipe end. Such an element can be in the form of a brush or a flexible disk. The flexibility of this element is such that a simple adaption to the existing contour is possible during the axial back and forth movement of the blast nozzle. Also, the material of this element must be heat resistant up to a temperature of approximately 600° C., because the blasting takes place immediately after the completion of the heated deforming procedure.

The outer blasting takes place in a known fashion, whereby a nozzle head is directed towards the pipe end, as described in connection with the inner blasting. A commercially available abrasive material, as for example, corundum, steel, grit (fine gravel) or wire granules are admixed, injector-like, with a carrier medium, usually compressed air. The required movement in the peripheral direction is achieved through turning of the pipe to be blasted or through swivelling of the blast head around the pipe. It seems to be advantageous to have a stationary pipe, with several nozzle heads arranged in a peripheral manner, to limit the required angle of swivel movement and thus keep the sealing problems for the supply lines to a minimum.

To provide noise protection and cleanliness of the adjacent machine installation, the entire device for the inner and outer blasting is contained with a single housing which is sound reducing. The entry of the pipe to be blasted, can for instance, be sealed off with a rubber collar. In order that the sensitive measuring devices for the touchless scanning of the outer contours of the heated deformed pipe ends do not get damaged, these devices can be folded out of the way during the blasting operation, and the instruments, if desired, can be covered.

The suggested blasting device for the inside is not only useful in the preparation described for the removal of scale in hot deformed pipe ends, but also can be generally used for any type of surface cleaning where the length of the inner surface is limited. It is unimportant for the process whether this concerns the removal of scale layers or the finishing, or other particles which stick to the surface, or the smoothing of the surface. It is important to protect the part of the pipe, which is not to be cleaned, from contamination by the abrasive in order to avoid a possibly very expensive subsequent cleaning operation.

In summary, one aspect of the invention resides broadly in a device for surface cleaning of the inner surface of a hot deformed pipe end, having an axially moveable blast lance carrying a blast nozzle head having a closed end, with at least one blast nozzle on the blast nozzle head, and a supply line for a gaseous medium and an abrasive which are mixed together in the blast head and discharged through the blast nozzle, the blast nozzle adjusted at an angle relative to the inner surface of the pipe, the improvement wherein: the blast lance has inner and outer coaxially aligned rotatable hollow tubes communicating with the blast nozzle head, each tube having an enlarged outer end; the inner tube has injectors thereon through which gaseous medium, and abrasive in the outer tube, are directed to the blast nozzle for discharge therethrough: an axial pipe is disposed coaxially within the inner hollow tube, forming an axial bore between the pipe and the hollow tube, and extends through the closed end of the blast nozzle head; a deflector attached to the closed end of the blast nozzle head having radially extending passageways which communicate with the axial pipe and penetrate through the periphery of the blast nozzle head to provide a gas curtain between the blast nozzle head and the inner surface of the pipe being cleaned; and a removeable heat resistant element, attached to the deflector, having an outer diameter at least as large as the largest inner diameter of the pipe being cleaned.

Another aspect of the invention resides broadly in a process for removal of scale and cleaning of a hot deformed pipe end with a blasting device, after the hot deformation thereof, the pipe having a deformed area, a deforming seam, and an undeformed section, the improvement comprising: blasting the entire deformed area of the pipe, on the inner and outer surfaces thereof, with an abrasive in a carrier medium; adding carrier medium, without abrasive, from a blasting device, as a radially directed curtain between the blasting device and the inner surface of the pipe during said blasting of the inner surface, to protect the undeformed section of the pipe from said abrasive; and removing the deforming seam.

BRIEF DESCRIPTION OF THE DRAWINGS

In the drawings, the device and its operation are further explained in more detail.

DESCRIPTION OF THE PREFERRED EMBODIMENT

Figure 1:
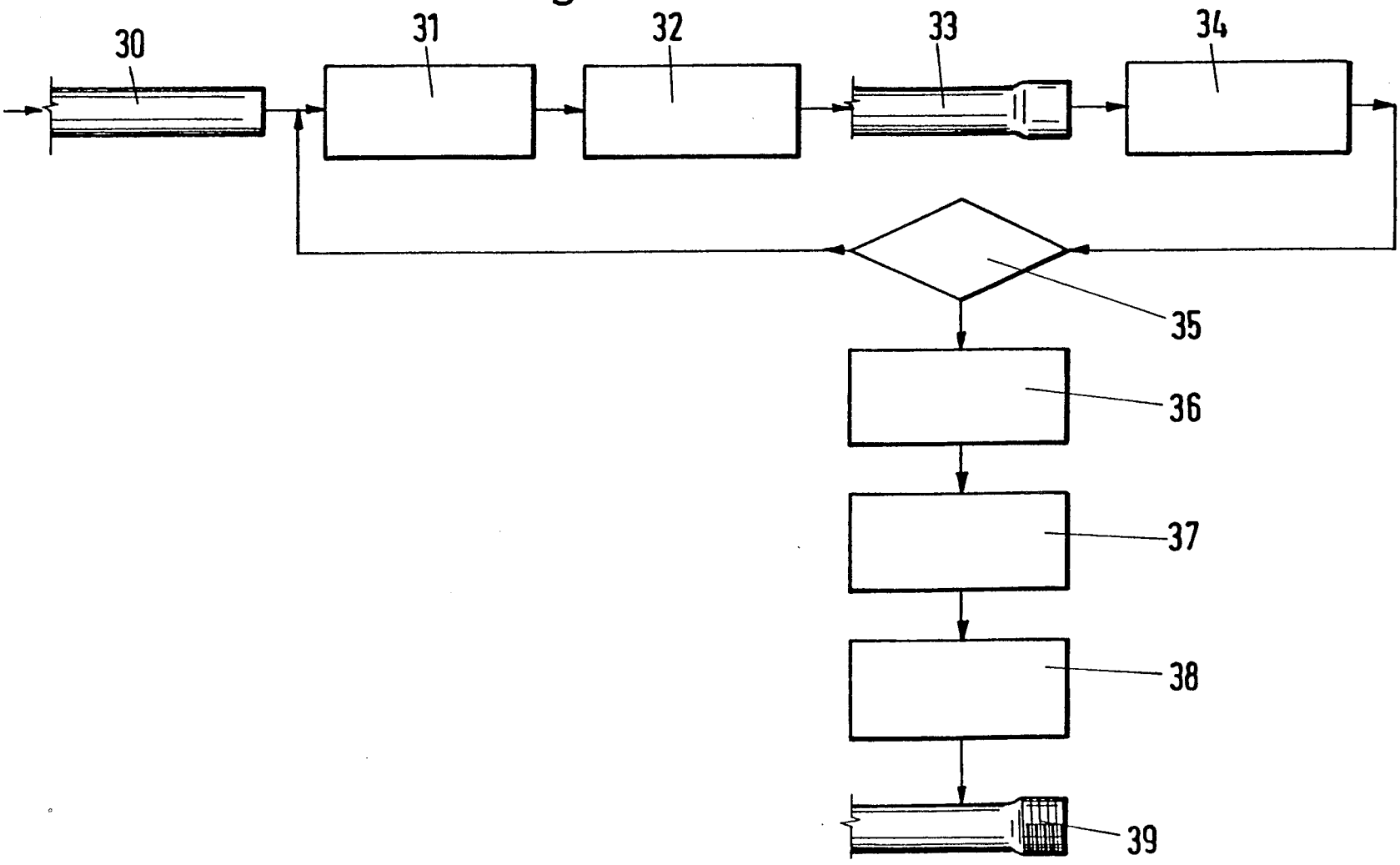
FIG. 1 is a flow chart of the process for the hot deforming and the subsequent mechanical processing.
Figure 2:
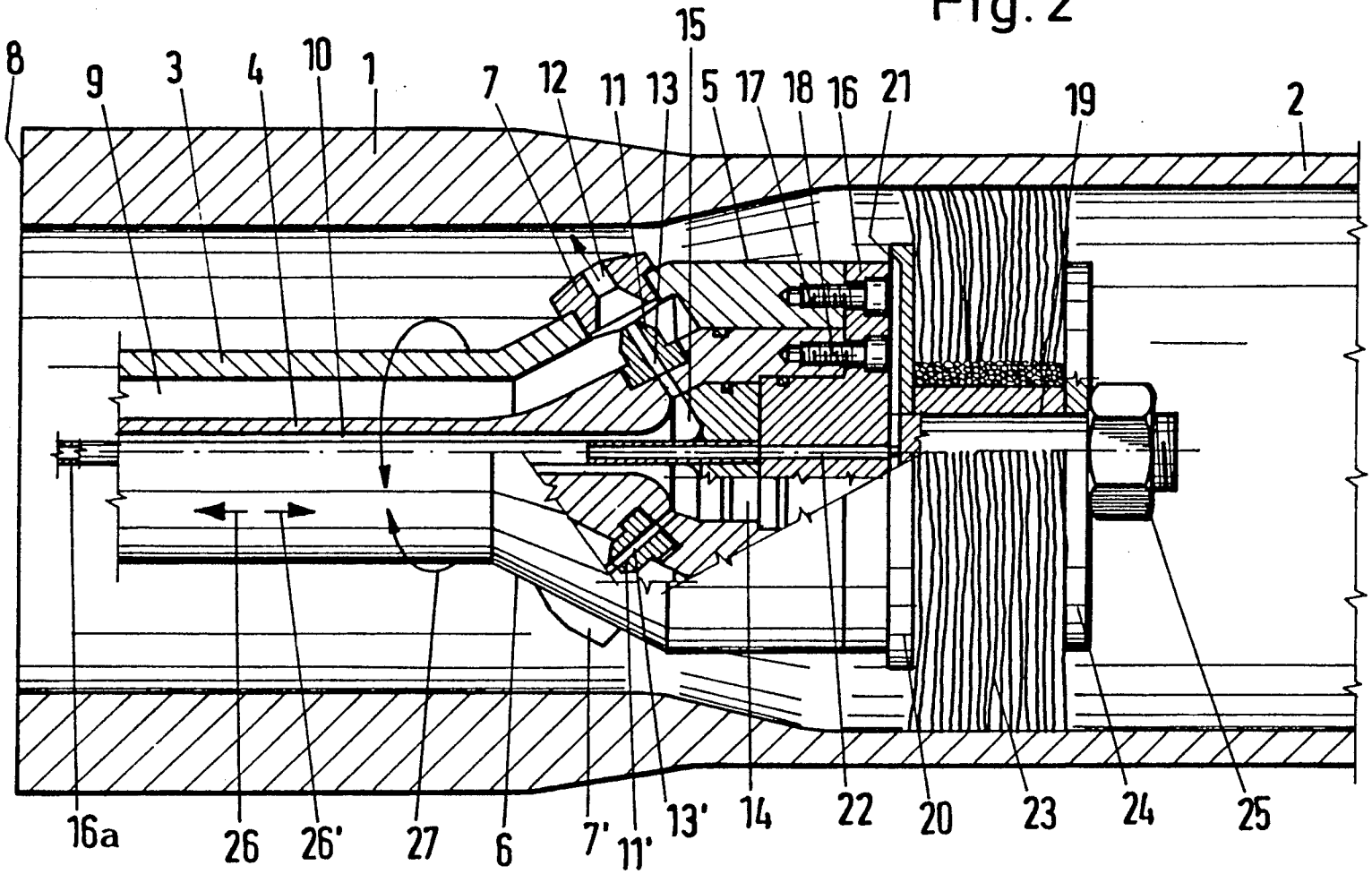
FIG. 2 is a longitudinal sectional view through the internal blasting device and pipe being cleaned.

Referring now to FIG. 1, steps for the heated deforming procedure and the subsequently occurring mechanical processing are shown. A pipe 30, the end or ends respectively of which are to be deformed, is fed first to a pre-heating device for instance, an induction processor. In this device 31, the respective ends are being heated to a transformation temperature and subsequently pass into a deforming press 32 where, for instance, two cooperating deforming half molds are attached and deform and increase the thickness of the pipe wall. The scale removal device 34 according to the present invention is located within the production line, where deformed pipe 33 is being fed with the deformed end. The details of one part of this scale removal apparatus are shown in FIG. 2. In this scale removal apparatus, the deformed pipe end is cleaned from the inside and outside. If several deforming steps, with different temperatures are required for making the final contour of the pipe end which is being deformed, then the procedure will be repeated beginning with step using device 31. The decision switch point is symbolized [In FIG. 1] with a rhombus, step 35. If one deforming step was sufficient, or respectively, if the last deforming step has been concluded, then either, simultaneously with the scale removal procedure at step 34, or subsequently, deforming seams 40 (See FIG. 3) are removed at step 36. The procedure of this seam removal step can be accomplished on a separate cleaning stand or on a scale removal device already described. The pipe, with clean pipe ends, subsequently is subjected to a visual inspection at step 37. After approval, the pipe will be mechanically processed, and the pipe receives a thread at 38. After completion of this work, and depending on the requirements, the threaded pipe 39 is either directly available for shipping or can otherwise be further treated.

FIG. 2 shows a longitudinal cross-section of an internal blasting device according to the invention for the removal of scale on the inner surface of a hot deformed pipe end 1. The original wall thickness of the undistorted pipe section 2 can be seen in the right hand of the picture. The internal blasting and the external blasting, which is not shown here, is either done simultaneously or in separate steps after each deforming procedure. FIG. 2 shows the contour of a hot deformed pipe end after the last deforming step. The inner blasting device has a lance, which carries the carrier medium for instance, air pressure, having two coaxially arranged hollow outer and inner tubes 3, 4 which at their ends communicate with blast nozzle head 5. On the outside of a cone-shaped part 6 of the blast nozzle head 5 are at least one or several blast nozzles 7, 7' arranged in a fixed angle in the direction of the input end 8 of the pipe to be blasted. The two attached coaxial hollow tubes 3, 4, form an annular chamber 9 through which the abrasive is supplied. In order to assure the abrasive will enter into the area of blasting nozzle 7, 7', it may be required to put annular chamber 9 under a light pressure from a carrier medium. The carrier medium required for the blasting is supplied through bore 10 of the inner tube 4, and blast head 5 and directed outside of the tube 4 through the injector nozzles attached to tube 4. The axis of the blast nozzle 7, 7' and the injector jets 11, 11' which are part of the blast nozzle, are aligned with each other, likewise, their bores 12, 13 and 13' are also aligned. The redirection of the supplied carrier medium occurs through a rotatably attached distribution unit 14 and through an enlargement of the inner tube 4. This distribution unit 14 has recesses 15 which are directed towards the input end 8, so that a communication is provided between the bore 10 of the inner tube 4 and the injector jets 11 or 11' respectively. With this arrangement, it is possible to control blast nozzle 7, 7' with a different adjustable angle, singularly or in groups.

The rotation of the distribution unit 14 occurs by use of a coaxial pipe **16*a* which is axially secured in the bore 10 of the inner tube 4, and is connected with and extends through the distribution unit 14. For the face side of the blast head 5, there is a lid 16 attached to enlarged ends of the two hollow tubes 3, 4 by screws 17, 18 and by a bolt-type extension 19. Attached by the bolt 19 is a deflector, in the form of a washer type body 20, in which deflector radially extending passages 21 are provided. The lid 16 is provided with a central bore 22, which is aligned with the bore of the centrally located pipe 16***a*. Compressed air is charged through this pipe 16*a*, through the central bore 22 of the lid 16, and then exits radially through passages 21 of the deflector or washer like body 20, and in this manner provides a shielding curtain. In order to increase the effectiveness of the shielding, the radial passages 21 of the deflector 20 are angled at the exit end in the direction of the input end 8, so that the exiting compressed air can counteract the abrasive material which is falling towards the back. For an even better type of shielding of the interior space of the pipe against abrasive material which rebounds from the inner surface of the pipe being cleaned, the bolt 19 carries a removeable, flexible, heat resistant element, such as brush 23. Brush 23 consists of flexible steel wires and is attached, by means of a disk or washer 24 and a nut 25, to the deflector 20. During the blasting, blast head 5 is axially moved back and forth, shown here through arrows 26, 26' and simultaneously, is also being rotated, or respectively only swivelled, here shown through arrow 27. The brush 23 has to perform this movement also and the diameter of the brush must be at least equal or somewhat larger than the largest inner diameter of pipe end 1, so that the function of shielding can be maintained during movement. In this example, the largest inner diameter is located in the undeformed section of the pipe, but during enlarging pipe deformation, it can be located in the deformed area.

As an alternate procedure for the above-described movement of the blasting head in an axial and circumference direction, it is also possible to have a corresponding movement of the pipe while the blast head 5 remains stationary.

Figure 3:
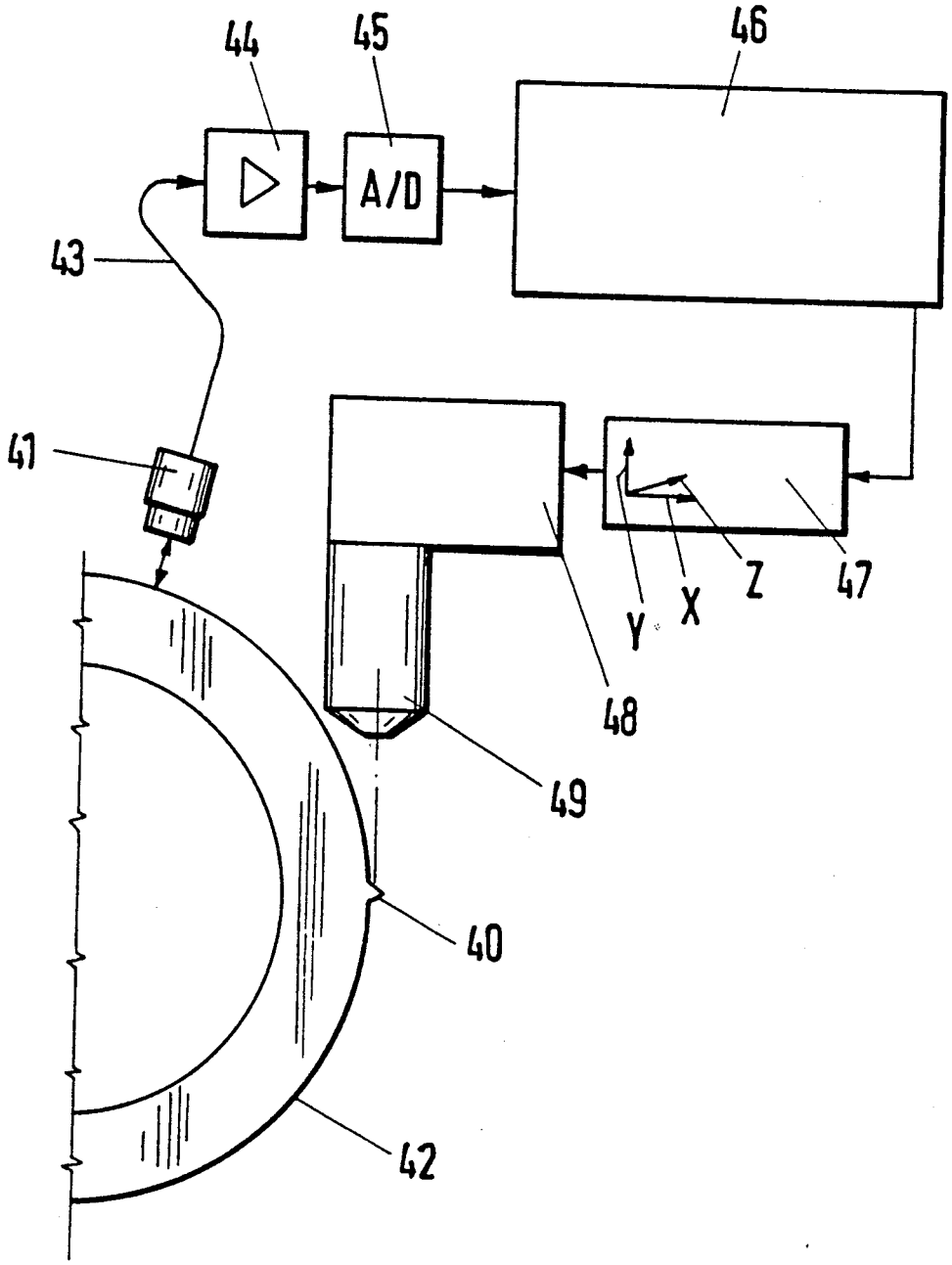
FIG. 3 is a schematic illustration of the touchless scanning device for the outer contour of the deformed pipe end.

FIG. 3 shows a schematic diagram of a touchless sensor procedure for the location of deforming seams 40. By means of a measuring device 41, for example, an inductive motion pickup, the outer contour 42 of the deformed pipe end 1 (FIG. 2) is being sensed without touching the pipe. The measured signals are given to an amplifier 44 by line 43 and subsequently are turned into digital values by means of an analog digital converter 45. These values then are entered into a computer 46 where the measured axial data is compared with the pre-set specification data. In the area of deforming seams 40, there is a deviation of the contour which is above a predetermined threshold value. From this, the computer determines the control coordinates and forwards them to control apparatus 47, where the control signals are forwarded to a moveable tool holder 48. The tool 49, is in this particular case schematically illustrated as a blast head, and the blast head is positioned by means of tool holder 48. The flow of abrasive which exits from the head can thus be directed towards the deforming seams 40 which are to be removed.

One feature of the invention resides broadly in a device for the surface cleaning of a hot upset pipe end, with at least one blast nozzle which is attached to a blast head, and from the blast head, there is a connected supply line for the gaseous carrying medium and blast material, which becomes mixed in a injector type manner within the blast head, and whereby the installation for the inner blasting and which device has an axial movable blast lance, which blast lance has a blast head which is attached and a support item is shown, and the blast nozzle in its longitudinal plane is adjusted at an angle in relation to the inner surface of the pipe, is characterized by the fact that for the purpose of inner blasting, the blasting lance consists of two co-axially attached hollow bodies 3, 4 which are moveable in the circumferial arrow 27 and which makes a compact unit with the blast head 5 which is attached thereto, and the blast nozzle 7,7' and which has an adjusted angle in relationship to the blast lance located under the input end 8 for the pipe to be blasted, and that the axial pipe 10 of the hollow body 3,4 is located on the inside, and which hollow body is connected by a duct which penetrates through the wall of this hollow body 4 in the direction of the entrance end, and on which end (duct) an aligned injector jets 11, 11' is attached to blast nozzle 7,7', and which a co-axially attached bore 10 serves for the formation of gas-like curtain which protects the inside of the pipe from the bouncing blasting material, and the axial bore 10 of the hollow body 4 which lays on the inside, penetrates through the blast head 5, (or pipe) is mounted in the area of the blast head end and are connected to the peripherally attached passages (or ducts) 21 which are located radially to the outside, and at the face side of the blast head 5, there is a flexible heat resisting element 23 that can be removed, and which outer diameter of the element is at least equal to or somewhat larger than the largest inner diameter of the pipe end.

Another feature of the invention resides broadly in a device characterized by the fact that blast head 5 has several blast nozzles 7, 7' which are distributed peripherally and the axial bore 10 (or pipe) of the hollow body 4 which is located in the inside in the area of the blast head 5 becomes an enlargement to which a rotatable distribution element 14 is attached, there is an axial bore 10 of the hollow body 4 which is located on the inside, there are corresponding recesses 15 on the side of the pipe which is to be blasted and are solidly connected with pipe 16 and extend to the input end 8 and whereby the corresponding position of the distribution element 14 in the periphery makes up a connection of bore 10 of the hollow body 4 to the injector jets 11, 11'.

Yet another feature of the invention resides broadly in a device characterized by the fact that blast nozzles 7.7' represents two or more nozzle groups with different adjusted exit angles for the blast material, whereby the exit angle within the group remains constant and the individual nozzle groups can be connected with bore 10 of the hollow body 4 which is located inside with the carrier medium.

A yet further feature of the invention resides broadly in a device characterized by the fact that the element is developed into a circular brush 23.

Still a further feature of the invention resides broadly in a device characterized by the fact that the element has at least one circular shaped disk.

A still further feature of the invention resides broadly in a procedure for the removal of scale and cleaning of the hot upset pipe end with the utilization of a device whereby the surface scale and the upsetting seams are being mechanically removed after the heat transformation characterized by the fact that the entire upset pipe end area including the transition point up to the beginning of the undeformed pipe is being blasted inside and outside after each set procedure, and after the last upset procedure the upsetting seams are also being removed, and that doing the blasting of the inside a certain amount of the added gas-like carrier medium is used without mixture of blast material from the middle radially over the entire circumference aimed at the inside surface, where the blasting source generate a wandering gas like curtain which protects the inside of the pipe from the entering blast material.

An additional feature of the invention resides broadly in a procedure characterized by the fact that the inner and outer blasting occurs simultaneously.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. In a device for surface cleaning of the inner surface of a hot deformed pipe end, having an axially moveable blast lance carrying a blast nozzle head having a closed end, with at least one blast nozzle on the blast nozzle head, and a supply line for a gaseous medium and an abrasive which are mixed together in the blast head and discharged through the blast nozzle, the blast nozzle for being adjusted at an angle relative to the inner surface of the pipe, the improvement wherein:

the blast lance has inner and outer coaxially aligned rotatable hollow tubes communicating with the blast nozzle head, each tube having an enlarged outer end;

the inner tube has at least one injector for directing gaseous medium to said at least on blast nozzle, which is located on the outer tube, for discharge therethrough, the outer tube for transporting the abrasive to mix it with the gaseous medium and to discharge the mixture through said at least one blast nozzle;

an axial pipe is disposed coaxially within the inner hollow tube, forming an axial bore between the pipe and the inner hollow tube, and extends through the closed end of the blast nozzle head:

a deflector attached to the closed end of the blast nozzle head having radially extending passageways which communicate with said axial pipe and penetrate through the periphery of said blast nozzle head to provide a gas curtain between the blast nozzle head and the inner surface of the pipe being cleaned; and a removeable flexible heat resistant element, attached to the deflector, having an outer diameter at least as large as the largest inner diameter of the pipe being cleaned.

2. In a device as defined in claim 1, the improvement wherein there are a plurality of peripherally located blast nozzles on the blast head, a rotatable distribution unit is attached to the enlarged outer end of said inner tube, and the distribution element has recesses therein communicating with said axial bore, with the recesses of said distribution element connecting the axial bore with the injectors.

3. In a device as defined in claim 2, the improvement wherein said plurality of blast nozzles are provided in nozzle groups with different adjusted angles for said mixture, whereby the exit angle within each group remains constant and each nozzle group is connectable with the axial bore.

4. In a device as defined in claim 1, the improvement wherein the flexible heat resistant element is a circular brush.

5. In a device as defined in claim 1, the improvement wherein the flexible heat resistant element has at least one circular shaped disk.

* * * * *